United States Patent [19]

Lair

[11] 4,232,605

[45] Nov. 11, 1980

[54] WARHEAD ORIENTATION DEVICE

[75] Inventor: Clair K. Lair, Upland, Calif.

[73] Assignee: General Dynamics Corporation Pomona Division, Pomona, Calif.

[21] Appl. No.: 168,507

[22] Filed: Jul. 22, 1971

[51] Int. Cl.[3] ..... F42B 23/24

[52] U.S. Cl. ..... 102/8; 89/1 R

[58] Field of Search ..... 42/78; 89/1; 244/3.1, 244/3.23; 102/8, 7.2

[56] References Cited

U.S. PATENT DOCUMENTS

| | | | |
|---|---|---|---|
| 1,235,637 | 8/1917 | Barlow | 102/7.2 |
| 1,316,033 | 9/1919 | Hayden | 244/3.1 |
| 1,316,363 | 9/1919 | Hayden | 244/3.1 |
| 2,830,538 | 4/1958 | Dodge | 102/8 |
| 2,900,873 | 8/1959 | Wust | 42/78 X |
| 2,967,369 | 1/1961 | Musser | 42/78 |
| 3,195,459 | 7/1965 | Reed, Jr. | 102/7.2 |

*Primary Examiner*—David M. Brown

*Attorney, Agent, or Firm*—John R. Duncan; Edward B. Johnson

[57] ABSTRACT

A warhead orientation device and its use in a directional attack mine are disclosed. The device includes a warhead launchable in a "pop-up" mode from a launch tube. The launch tube and warhead have a cooperating pin and helical groove system which imparts spin to the warhead during ejection from the tube. A stationary "fly wheel" type mass is attached to the spinning warhead. A cooperating pin and straight groove system on the mass and tube prevent rotation of the mass during ejection. This combination of spinning warhead and decoupled stationary mass provide a stable platform in one axis. Thus, suitable sensors and firing mechanisms may be used to cause a directional firing mechanism in the warhead to fire in a selected direction after pop-up.

10 Claims, 4 Drawing Figures

WARHEAD ORIENTATION DEVICE

BACKGROUND OF THE INVENTION

This invention herein described was made in the course of or under a contract with the Department of the Air Force.

This invention relates to directional attack mines and, more specifically, to a means for providing a moment of inertia stable platform in one axis for use in such mines.

Mines of the "pop-up" type have long been used, both for defensive and attack purposes. In general, these mines consist of a pop-up or ejection charge, which is detonated when a sensor, such as a trip-wire, is actuated. A warhead is popped-up, generally to a height of 3–10 feet, where it detonates. Since the warheads are ordinarily non-directional, the lethal area covered by the warhead is limited because the explosive energy is uniformly dissipated in all directions. Thus, the primary use for these mines is with anti-personnel fragmentary warheads.

A directional warhead would have greater utility, since by concentrating the explosive energy and fragments in a single direction, the effect of the mine could be extended over a greater distance.

While sensors are available which can detect a target, such as a moving vehicle, discern the range, azimuth and closest point of approach and fire a weapon, it has been generally difficult to aim a pop-up warhead so that the force of a directional charge in the warhead is oriented in azimuth.

Thus, there is a continuing need for improvements in warhead orientation means for use in such systems.

SUMMARY OF THE INVENTION

It is, therefore, an object of this invention to provide a warhead orientation device overcoming the above noted problems.

Another object of this invention is to provide a warhead orientation device of improved simplicity and reliability.

Still another object of this invention is to provide an improved moment of inertia stable platform for a warhead orientation device.

A further object of this invention is to provide a warhead orientation device having improved directional accuracy.

The above objects, and others, are accomplished in accordance with this invention by a device which basically includes a warhead having a main body portion adapted to be rotated about an axis and a stable mass, in the nature of a fly wheel, mounted on the body portion in a manner which permits the stable mass to remain stationary with respect to the earth while the body portion is spinning. At least one outwardly-extending pin on the body portion cooperates with at least one angled groove on the inner wall of the launch tube to cause rotation of the body during warhead ejection from the tube. At least one outwardly-extending pin on the stable mass cooperates with a straight groove, parallel to the launch axis, on the inner wall of the tube to prevent rotation of the mass during ejection.

This combination of a spinning warhead body and a stationary stable mass assure stability of the warhead during launch, and permits the directional charge in the spinning warhead to be fired when it is pointed in the pre-launch determined direction. The stable mass is decoupled from the warhead body by means of a low torque spin bearing which allows free relative rotary motion between mass and body. A thrust bearing supports the mass against shock loads during launch.

BRIEF DESCRIPTION OF THE DRAWING

Details of the invention, and of a preferred embodiment thereof, will be further understood upon reference to the drawing, wherein.

DETAILED DESCRIPTION OF THE INVENTION

Figure 1:
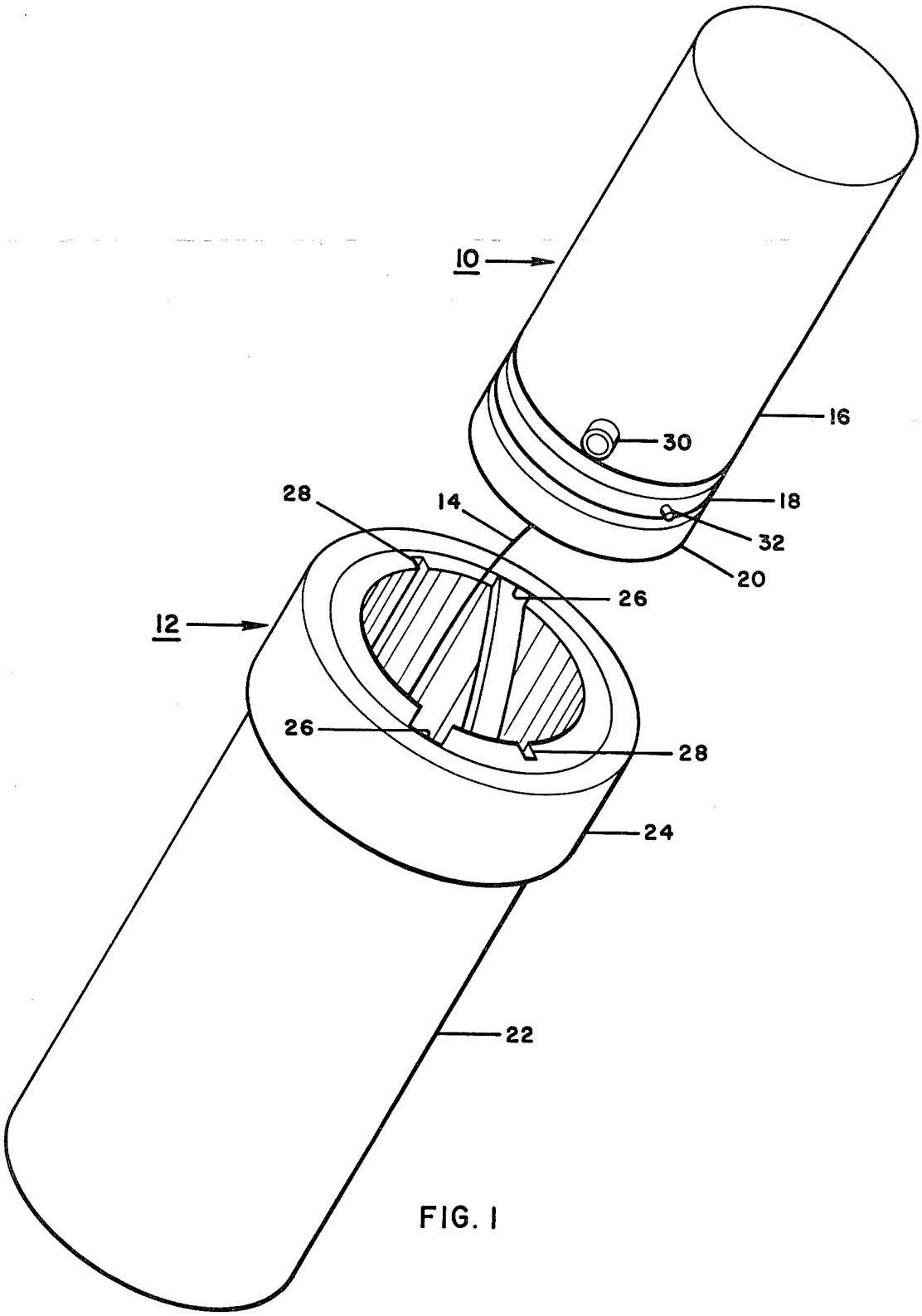
FIG. 1 is a perspective view of a "pop-up" type mine warhead adjacent to its launch tube.
Figure 2:
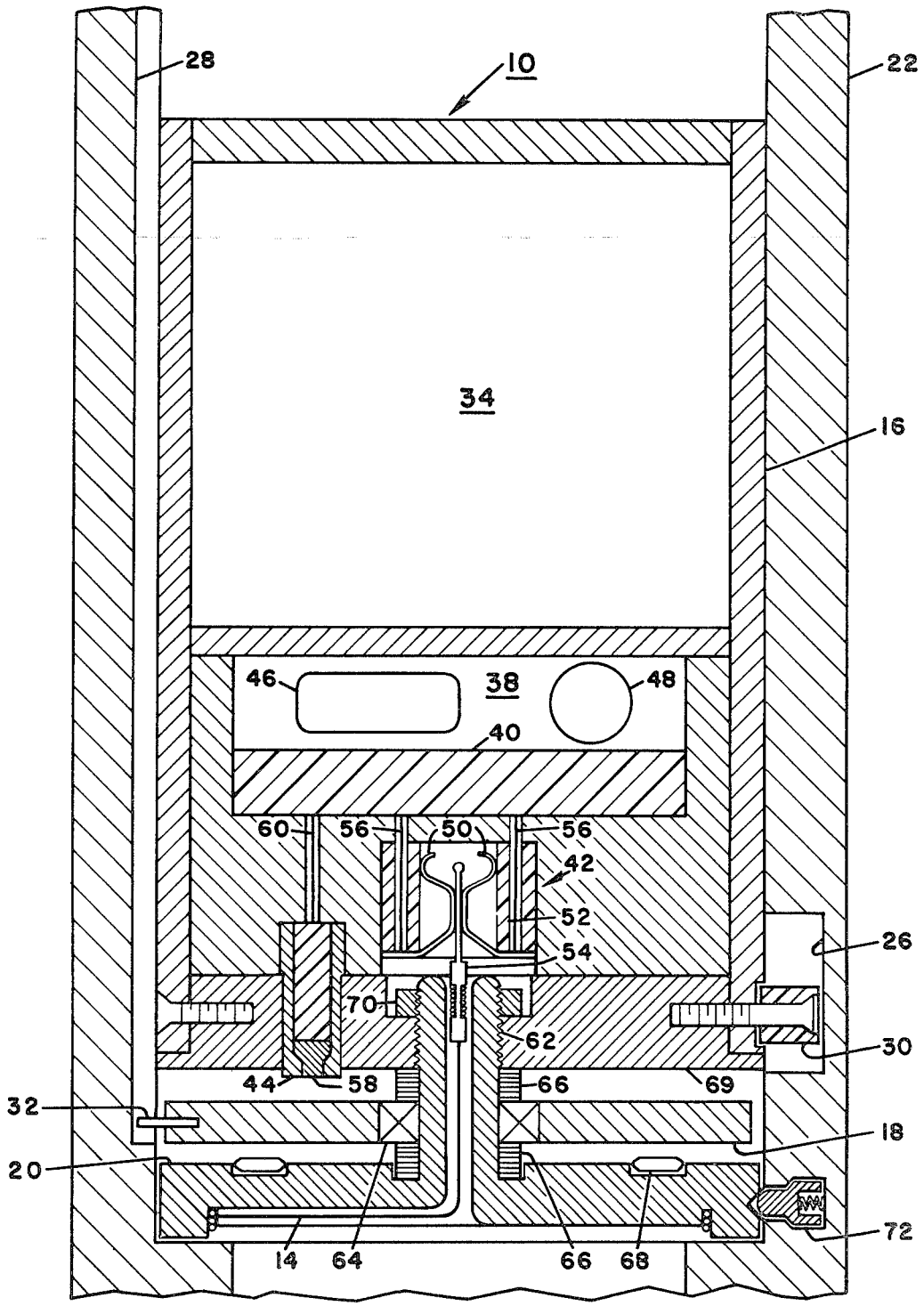
FIG. 2 is an axial section through the warhead installed in the launch tube.
Figure 3:
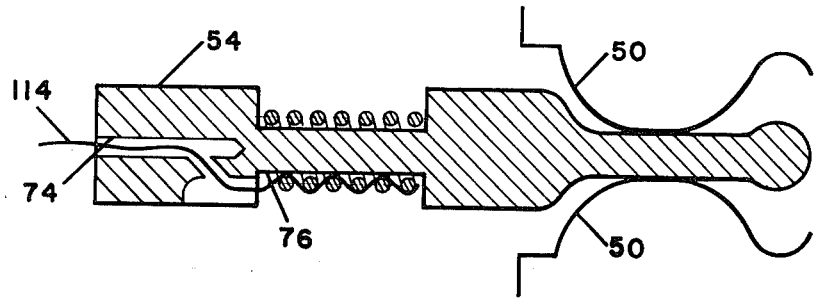
FIG. 3 is a detail plan view of the lanyard warhead arming means.

Referring now to FIG. 1, there is seen a preferred embodiment of a directional mine warhead 10 adjacent to a launch tube 12, connected thereto by an arming lanyard wire 14. Warhead 10 includes a main body 16, a stable mass 18 mounted for rotation relative to body 16 around the axis of the cylindrical warhead, and a base plate 20 which is secured to body 16 by a shaft passing through stable mass 18 (as best seen in FIG. 2).

Launch tube 12 comprises a main tube 22 and a reinforcing ring 24. The inner wall of tube 22 contains a pair of helical grooves 26 and a pair of straight grooves 28 parallel with the tube axis. While any suitable number of grooves 26 and 28 may be used, preferably 2 or more of each are provided, evenly spaced around tube 22, for dynamic balance.

A pair of first guide pins 30 mounted on main body 16 are adapted to follow grooves 26 when warhead 10 is inserted in launch tube 12. Similarly, a pair of second guide pins 32 mounted on stable mass 18 ride in straight grooves 28. Thus, when warhead 10 is ejected from tube 12 by an explosive charge at the bottom of tube 22, the warhead body 16 and attached base plate 20 are caused to rotate as first guide pins 30 move along helical grooves 26 during ejection. Meanwhile, second guide pins 32 moving in straight grooves 28 prevent rotation of stable mass 18. Thus, as warhead 10 "pops-up", stable mass 18 has a constant, stable orientation relative to the earth, while the directional charge in body 16 is rapidly and continuously scanning a full circle. As discussed in detail below, an electronic system within warhead 10 can fire the directional charge in any selected direction relative to stable mass 18.

As warhead 10 "pops-up", it is armed at a desired height, such as six feet, by a wire lanyard 14 which connects warhead 10 to launch tube 12. When lanyard 14 is uncoiled to its full length, an arming means connecting the lanyard 14 to warhead 10 is pulled out, closing an arming switch, as explained below. Of course, any other suitable arming system could be used in place of the lanyard switch system. For example, a clock-like timing mechanism could be used to arm the warhead when an appropriate time interval after launch has elapsed, or a counter could arm the warhead after counting a suitable number of revolutions of body 16 relative to mass 18 after launch.

While launch tube 12 is illustrated in a generally cylindrical form, it may have any suitable shape. For example, to assure vertical orientation of the tube, a flat base plate may be attached to tube 22. Or, if the mines are to be dropped from aircraft, fins may be added to assure a vertical fall and the base may be provided with a spike which would penetrate the earth and hold the mine in an upright position.

FIG. 2 shows the internal components of warhead 10 and main launch tube 22. While straight groove 28 would not ordinarily be directly opposite helical groove 26, it has been rotated to this position in FIG. 2 for clarity of illustration.

Basically, main body 16 of warhead 10 contains an upper space 34 adapted to hold a selected conventional directional explosive charge (not shown) and a lower compartment 36 which contains a power supply 38, electronic components for the sensing and firing circuits (shown here as potted in a synthetic resin mass 40), an arming switch 42 and a position sensor 44.

Figure 4:
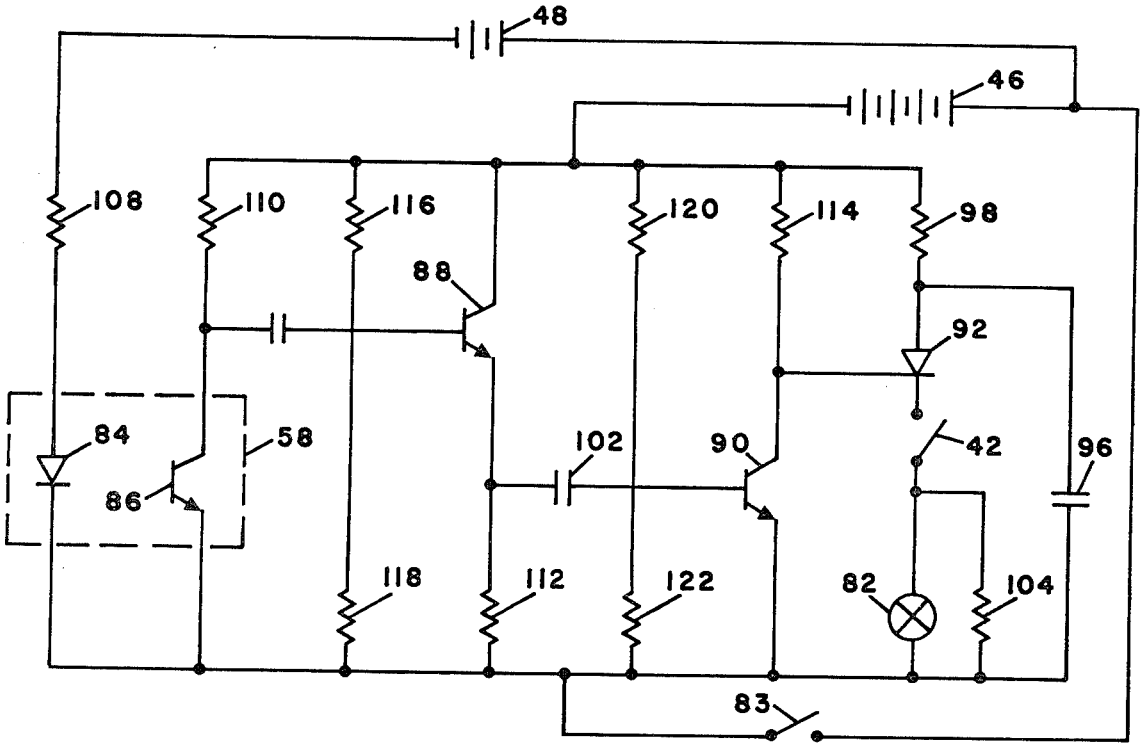
FIG. 4 is a schematic diagram of a directional warhead firing circuit.

Power is supplied by schematically illustrated batteries 46 and 48 within space 38. The solid-state firing circuit components, powered by these batteries, are embedded within potting compound 40. A typical firing circuit is illustrated in FIG. 4, as described below.

The arming switch 42 includes an annular insulating sleeve 52 within which two opposing spring members 50 are mounted. Spring members are biased toward one another so that they will move into contact upon removal of lanyard body 54. Spring members 50 are secured to sleeve 52 at their lower ends and are free at their upper ends. Wires extend from the lower ends of spring members 50 through holes 56 in the wall of sleeve 52 to the electronic components within mass 40.

Position sensor 44 includes a light emitting diode and a photodetector generally indicated at 58. One or more spaced reflective strips or spots (not shown) on the upper surface of stable mass 18 reflect light from the light emitting diode back to the photodetector once for each strip during each revolution of mass 18. The resulting electrical pulse passes through wire 60 to the electrical components within mass 40. As is discussed in detail below, the shaped charge within 34 is fired in the desired direction by detonating it after a suitable delay after the sensor pulse is received.

Stable mass 18 rotates around hollow shaft 62 on ball bearing 64. Belleville springs 66 above and below mass 18 support it for rotation around shaft 62 in the desired plane. Shaft 62 is threaded into end closure plate 69 and secured by jam nut 70. Since mass 18 will move axially along shaft 62 during "pop-up" acceleration, needle thrust bearings 68 are provided on the upper face of base plate 20. This allows a small, low torque, spin bearing 64 to be used to improve accuracy.

A detent in the side of base plate 20 engages a spring-loaded latch member 72 to hold the warhead 10 in the proper position within tube 22 until firing.

Details of the lanyard body 54 and the means connecting lanyard wire 14 thereto are shown in FIG. 4. Wire 14, which preferably is a very strong, thin wire, extends through a hole 74 in the base of body 54, then along a narrow portion 76 of body 54. Since wire 14 is very stiff, it is difficult to securely fasten to body 54. However, it has been found that secure attachment can be obtained by wrapping a relatively soft wire 78 around narrow portion 76 with wire 14 alternating above and below the wrapping wire. The end of body 54 extends between spring members 50 which are biased toward each other. As warhead 10 leaves tube 22, wire 14 uncoils and eventually, such as after about a 6 foot warhead travel, is fully extended. Then, it pulls body 54 from between spring members 50, permitting them to come together and completing the warhead arming circuit. As warhead 10 rotates, it will fire at the selected angle during the next rotation cycle.

A typical arming and firing circuit is illustrated in FIG. 5. Any other suitable circuit may be used, if desired. Any suitable system may be used to cause the warhead ejection charge to fire, such as trip-wires, acoustic sensors, etc. As the warhead pops-up, lanyard 14 will arm the warhead at the given height and the directional charge will fire at the selected angle to the reflective strip on stable mass 18, since the mass does not rotate relative to the earth. Of course, the delay between sensing a pulse and firing may be adjusted by any suitable conventional method. Alternatively, a simple memory and signal receiving circuitry may be included in the warhead which cooperates with an electronic sensor and signal transmitter so that the sensor can detect intruders from any direction and pass a signal to the warhead to fire the directional charge in the desired direction by automatically choosing the proper pulse from sensor 44.

A typical firing circuit is schematically illustrated in FIG. 5. A power switch 80 is provided so that the circuit can completely inactivate when the warhead is out of the launch tube. This switch may be actuated in any suitable manner, such as a set-screw in body 16 which can be turned to operate switch 80.

The explosive shaped charge is indicated at 82. Any suitable explosive system may be used, to be detonated in any conventional manner.

The sensor assembly, generally designated 58, includes a light emitting diode 84 and a photo transistor 86 which detects light from diode 84 reflected by reflective strips on stable mass 18 and responds with a pulse output.

The lanyard switch is closed when the lanyard wire 14 deploys during pop-up, becomes taut and pulls body 54 from between contacts 50 (as seen in FIG. 4). This arms the firing circuit.

With switch 42 closed, photo transistor 86 exhibits an impedance change when a reflective strip passes sensor 58. Transistors 88 and 90 amplify the response of photo transistor 86 to a level which will gate "ON" the SCR 92. The circuit typically has a delay of about 20 microseconds to conduct after a signal from light emitting diode 84.

Inadvertent firing of the shaped charge by closing power switch 80 with the lanyard out of place (causing switch 42 to be closed) is prevented by capacitor 96 and resistor 98. When power switch 80 is closed, capacitor 96 is charged through resistor 98. Resistor 98 is chosen to allow approximately a 3 second arming delay with a maximum current of about 1 milliamp, so that if lanyard body 54 is not in place, or switch 42 is shorted, SCR 92 will be gated "ON" by the power "ON" transient, but the shaped charge 82 will not fire at the low current level. Further capacitors 100 and 102 are designed such that about 600 rpm of the warhead is required before a gate pulse will occur at SCR 92. This allows an inadvertent lanyard retraction without the safety hazard a direct current-coupled system would present. Resistor 104 is in shunt with the shaped charge 82 firing means, which typically is a resistance bridgewire. This bridgewire if broken would open the circuit which effectively would turn off SCR 92 (without resistor 104) and allow capacitor 96 to charge. If the power were now turned "OFF" and the ignition bridgewire replaced, capacitor 96 could maintain enough charge to inadvertently fire the shaped charge. However, with resistor 104 in the circuit, SCR 92 will remain "ON" when the bridgewire opens, and SCR 92 will be at approximately 1 volt until the power is removed.

In a typical firing circuit, the components may have the following values and characteristics: resistor 108, 6 ohms; resistors 110, 112 and 114, each 10 kilohms; resistors 116 and 118, each 49.9 kilohms; resistor 120, 75 kilohms; resistor 122, 24.9 kilohms; resistor 98, 7.87 kilohms; resistor 104, 1 kilohm; capacitors 100 and 102, each 3.3 microforad (15 volt); capacitor 96, 440 microforad (1 volt); battery 48, 1.5 volt (such as a Burgess AL-09 AA alkaline cell); battery 46, 9 volt (such as a Burgess 2 MN 6), photo transistor 84, typically to TIL01 emitting diode (available from Texas Instruments); transistors 88 and 90, each typically a 2 N 2222 A transistor from Motorola; and SCR 92, typically a 2 N 885 SCR from Texas Instruments. With these components, a delay of approximately 20 microseconds is experienced. Directional firing accuracy within ±4° is generally obtained.

While specific components, arrangements and dimensions are described in the above description of a preferred embodiment, these may be varied as discussed above with similar results. For example, any suitable sensing and "pop-up" charge firing circuit and shaped charge firing circuit may be used. Other modifications and applications of the present invention will occur to those skilled in the art upon reading the present disclosure. These are intended to be included within the scope of this invention, as defined in the appended claims.

I claim:

1. A directional warhead capable of ejection from a launch tube comprising;

a generally cylindrical body containing an explosive charge in one end thereof;

at least one first guide pin extending outwardly from the cylindrical wall of said body adapted to engage at least one first groove in a warhead launch tube;

a base plate mounted adjacent said body at the end opposite said explosive charge in said body, said base plate provided with an upper face having at least one thrust bearing;

a shaft attached to said base plate;

a stable mass revolubly coupled to said shaft by means permitting free relative rotation between said body and said mass around the axis of said body, said stable mass located adjacent said base plate against the upper face and said at least one thrust bearing of which said mass is forced by acceleration forces during warhead ejection;

at least one second guide pin extending outwardly from said mass adapted to engage at least one second groove in said warhead launch tube;

an electrical power source contained within said body;

arming switch means connected to said power source for arming said warhead, said arming switch means arming detonating means for detonating said explosive charge in said warhead when the warhead has reached a predetermined height above a launch tube after ejection therefrom; and position sensing means connected to said power source for sensing a direction in which to detonate said explosive charge in said ejected warhead.

2. The directional warhead according to claim 1 wherein said stable mass is supported by a low torque spin bearing for rotation around said shaft and is positioned along said shaft by Belleville springs.

3. The warhead according to claim 1 wherein said at least one first guide pin consists of two pins substantially equally spaced around the circumference of said cylindrical wall and said at least one second guide pin consists of two pins substantially equally spaced around the circumference of said stable mass.

4. The warhead according to claim 1 wherein the face of said rotating stable mass adjacent to said body includes at least one mark which is sensed by said position sensing means during relative rotation of said body and said mass.

5. A directional attack mine comprising:

a launch tube adapted to receive a directional warhead;

means to eject said directional warhead from said tube;

a directional warhead adapted to fit within said launch tube, said warhead comprising:

a generally cylindrical body containing an explosive charge at one end thereof;

at least one first guide pin extending outwardly from said body;

at least one first groove in the inner wall of said tube adapted to receive said first pin;

at least one second guide pin extending outwardly from said mass;

at least one second groove in the inner wall of said tube adapted to receive said second pin;

one of said first and second grooves being substantially parallel to the axis of said cylindrical body and the other lying at an angle to said axis;

a base plate mounted adjacent said body at the end opposite said explosive charge in said body, said base plate provided with an upper face having at least one thrust bearing;

a shaft attached to said base plate;

a stable mass revolubly coupled to said shaft by means permitting free relative rotation between said body and said mass around the axis of said body, said mass located adjacent said base plate against the upper face and said at least one thrust bearing of which said mass is forced by acceleration forces during warhead ejection from said launch tube;

an electrical power source contained within said body;

arming switch means connected to said power source for arming said warhead, said arming switch means arming detonating means for detonating said explosive charge in said warhead when said warhead has reached a predetermined height above said launch tube after ejection therefrom; and position sensing means connected to said power source for sensing a direction in which to detonate said explosive charge in said ejected warhead.

6. The attack mine according to claim 5 wherein said at least one first groove has a generally helical configuration whereby said guide pins engaged therein follow a helical path during warhead ejection, so that said body is caused to rotate about the axis of said body and launch tube and said at least one second groove is substantially straight and parallel to the axis of said warhead ad launch tube, whereby rotation of said mass during warhead ejection is prevented.

7. The attack mine according to claim 5 wherein said stable mass is supported by a low torque spin bearing for rotation around said shaft and is positioned along said shaft by Belleville springs.

8. The attack mine according to claim 5 wherein the face of said rotating stable mass adjacent to said body includes at least one mark which is sensed by said position sensing means during relative rotation of said body and said mass.

9. The attack mine according to claim 5 wherein two first grooves are provided substantially equally spaced around the internal wall of said tube and two first guide pins are provided substantially equally spaced around the circumference of said body.

10. The attack mine according to claim 9 wherein two second grooves are provided, substantially equally spaced between said two first grooves, and two second guide pins are provided substantially equally spaced around the circumference of said mass.

* * * * *